US005579929A

United States Patent [19]

Schwartz

[11] Patent Number: 5,579,929

[45] **Date of Patent: *Dec. 3, 1996**

[54] HOLDER FOR ROD-SHAPED WORKPIECES

[76] Inventor: Hans Schwartz, Am Hang 2, D-88447 Warthausen-Oberhöfen, Germany

[ * ] Notice: The term of this patent shall not extend beyond the expiration date of Pat. No. 5,452,810.

[21] Appl. No.: 479,642

[22] Filed: Jun. 7, 1995

Related U.S. Application Data

[63] Continuation of Ser. No. 192,140, Feb. 4, 1994, Pat. No. 5,452,810.

[30] Foreign Application Priority Data

Feb. 6, 1993 [DE] Germany ..... 43 03 501.9

[51] Int. Cl.[6] ..... A47B 73/00

[52] U.S. Cl. ..... 211/74; 206/446

[58] Field of Search ..... 211/60.1, 62, 65, 211/69.1, 70.1, 70.6, 70.8, 76, 189; 206/446; 248/548, 224.1, 224.2, 223.4

[56] References Cited

U.S. PATENT DOCUMENTS

| | | | |
|---|---|---|---|
| 2,251,744 | 8/1941 | Kurath et al. | 24/259 |
| 2,505,075 | 4/1950 | Weinberger | 248/121 |
| 2,577,120 | 12/1951 | Franz | 211/189 |
| 2,615,577 | 10/1952 | Bartleman | 211/60 |
| 3,142,385 | 7/1964 | Kahlenberg | 211/74 |
| 3,918,920 | 11/1975 | Barber | 23/292 |
| 4,190,166 | 2/1980 | Allsop | 211/60.1 |
| 4,199,070 | 4/1980 | Magnussen, Jr. | 211/189 |
| 5,080,232 | 1/1992 | Leoncavallo et al. | 206/446 |
| 5,148,919 | 9/1992 | Robin | 206/443 |

FOREIGN PATENT DOCUMENTS

| | | | |
|---|---|---|---|
| 4693904 | 2/1992 | European Pat. Off. | 211/60.1 |
| 2623040 | 11/1977 | Germany . | |
| 2807119 | 8/1979 | Germany . | |
| 3641411 | 6/1988 | Germany . | |
| 7415294 | 5/1975 | Netherlands | 211/189 |

*Primary Examiner*—Karen J. Chotkowski
*Assistant Examiner*—Gwendolyn Wrenn-Baxter
*Attorney, Agent, or Firm*—Robert W. Becker & Associates

[57] ABSTRACT

A device for holding rod-shaped workpieces, especially test tubes, has a base plate spaced at a distance from a support surface. A receiving and clamping device has at least two elastic tongues that are displaceable in the plane of the base plate. The tongues are positioned in a perforation of the base plate and act in pairs on the test tube. The holding device is extremely simple in its design and economical to manufacture, but ensures a reliable securing of the test tube at different levels.

32 Claims, 11 Drawing Sheets

HOLDER FOR ROD-SHAPED WORKPIECES

This application is a continuation-in-part application of allowed application Ser. No. 08/192,140 filed Feb. 4, 1994 now U.S. Pat. No. 5,452,810.

BACKGROUND OF THE INVENTION

The present invention relates to a device for holding rod-shaped workpieces, especially for holding cylindrical containers, for example, in the form of test tubes. The device is comprised of a base plate which is spaced at a distance from a support surface, the base plate having means for receiving and clamping a workpiece.

From German Offenlegungsschrift 36 41 411 a holder for an insulating bottle (thermos bottle) and a beaker to be connected thereto is known. The clamping means in this device are embodied as clamps in the form of an elastic arm with which the insulating bottle, respectively, the beaker is gripped within a range of 120° and pressed against a stationary arm. The elastic arm as well as the stationary arm project past the bottom side of the holder comprised of a yoke and a top plate and extend thus in the direction of the objects to be clamped.

Due to the contact of the elastic and the stationary arm over a large area in the axial direction of the insulating bottle and the beaker, these objects are securely held within the holder. However, due to its particular embodiment this holder is only suitable for the disclosed objects, respectively, for two coordinated objects. It is especially disadvantageous that the expenditure for the manufacture of this holder is extremely great because the projecting parts of the top plate as well as the elastic and stationary arms require complicated tools. Moreover, the known holder is relatively large and a versatile use of this device is thus not possible.

It is therefore an object of the present invention to provide a device for holding rod-shaped workpieces of the aforementioned kind that is not only simple in its constructive design and economical to manufacture, but also provides for a secure and reliable holding of different workpieces. Furthermore, it should be possible to arrest a workpiece, depending on the distance from the support surface to the base plate, at different levels. Furthermore, it should be possible to exactly position the workpiece within the base plate so that the holder is usable for receiving containers in an automated manner, for example, within laboratory apparatus. The holding device should however be producible by injection molding without requiring additional assembly work, whereby manufacturing tolerances can taken into consideration. The device should be usable in a versatile manner while providing for a simple handling.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
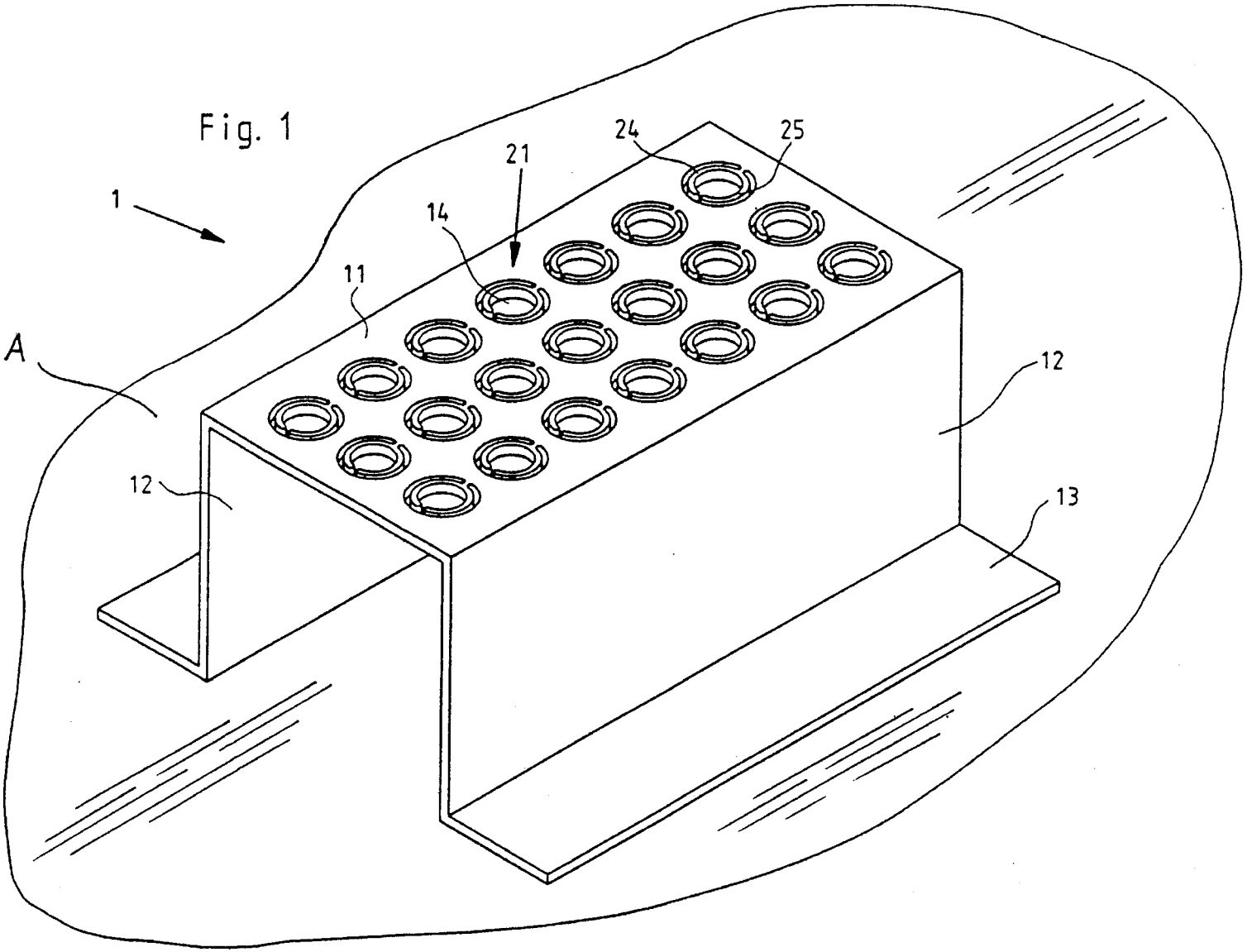
FIG. 1 shows the inventive holding device in the form of a test tube stand in a perspective representation.

The device for holding rod-shaped workpieces according to the present invention is primarily characterized by:

a base plate having means for spacing the base plate at a distance from a support surface;

a means on the base plate for receiving and clamping a workpiece;

the means for receiving and clamping having at least two elastic tongues that are displaceable in a plane of the base plate;

the tongues positioned in a perforation within the base plate;

the tongues acting in pairs on the workpiece; and the tongues comprising a tensioning means for biasing the tongues toward the workpiece, the tensioning means being an insert embedded in the tongues.

Preferably, the perforation has a peripheral wall and the means for receiving and clamping is comprised of one of the pairs of tongues, the tongues arranged opposite one another for receiving the workpiece therebetween such that each of the tongues engages the workpiece with a range of more than 90° over a periphery of the workpiece. The tongues have a first and a second end and a common stay for connecting the first ends of the tongues to the peripheral wall of the perforation at a common location opposite the second ends.

Expediently, the tongues enclose a cutout for receiving the workpiece and the perforation, at a location diametrically opposite the stay, communicates with the cutout and is positioned concentrically relative to the tongues.

Preferably, the cutout has at least one abutment that is formed as a unitary part of the base plate at the stay.

In a preferred embodiment of the present invention, each one of the tongues has an inwardly extending abutment projection for abutting the workpiece. The abutment projection is preferably positioned at a free end of the tongue.

In another embodiment of the present invention, the tongues are at least partially supported at the peripheral wall of the perforation, when the workpiece is inserted between the tongues. The tongues preferably have outwardly extending projections that rest at the peripheral wall of the perforation, when the workpiece is inserted between the tongues.

Advantageously, the insert is selected from the group consisting of a spring ring and a leaf spring.

The tongues expediently have at least three abutment projections that extend radially inwardly from the peripheral wall of the tongues and are formed as a unitary part of the tongues. One of the abutment projections is advantageously positioned at the stay and two of the abutment projections are positioned at free ends of the tongues.

Preferably, the tongues have at least three support projections that extend upwardly past an upper surface of the base plate. Each one of the abutment projections has a corresponding one of the support projections, wherein each one of the abutment projections and the corresponding support projection form together a single projecting member as a unitary part of the tongues. The projecting members are radially aligned with one another. Preferably, one of the projecting members is formed at the stay.

In yet another embodiment of the present invention, the tongues have a length such that, in an initial position before receiving the workpiece, free ends of the tongues abut one another.

The tongues have a length such that, in an initial position before receiving the workpiece, free ends of the tongues abut an abutment arranged between the free ends, wherein the abutment is a radial projection extending radially inwardly from the peripheral wall of the perforation at a location opposite the stay.

The invention concerns another device for holding rod-shaped workpieces which is primarily characterized by:

a base plate having means for spacing the base plate at a distance from a support surface;

a means on the base plate for receiving and clamping a workpiece;

the means for receiving and clamping having at least two elastic tongues that are displaceable in a plane of the base plate;

the tongues positioned in a perforation in the base plate;

the tongues acting in pairs on the workpiece;

the tongues having projections extending in an axial direction of the workpiece and connected to a downwardly facing side of the tongues;

the tongues having a tensioning means for biasing the tongues toward the workpiece, the tensioning means being an insert embedded in the projections.

Preferably, the perforation has a peripheral wall and the means for receiving and clamping is comprised of one of the pair of the tongues, the tongues arranged opposite one another for receiving the workpiece therebetween such that each of the tongues engages the workpiece with a range of more than 90° over a periphery of the workpiece. The tongues have a first and a second end and a common stay for connecting the first ends of the tongues to the peripheral wall of the perforation at a common location opposite the second ends.

The tongues enclose a cutout for receiving the workpiece and the perforation, at a location diametrically opposite the stay, communicates with the cutout and is positioned concentrically relative to the tongues. The cutout has at least one abutment that is formed as a unitary part of the base plate at the stay.

Expediently, one of the tongues has an inwardly extending abutment projection for abutting the workpiece. The abutment projection is advantageously positioned at a free end of the tongue.

Preferably, the tongues are at least partially supported at the peripheral wall of the perforation, when the workpiece is inserted between the tongues. The tongues have outwardly extending projections that rest at the peripheral wall of the perforation, when the workpiece is inserted between the tongues.

The insert is preferably selected from the group consisting of a spring ring and a leaf spring.

The tongues have at least three abutment projections that extend radially inwardly from the peripheral wall of the tongues and are formed as a unitary part of the tongues. One of the abutment projections is positioned at the stay and two of the abutment projections are positioned at free ends of the tongues.

Preferably, the tongues have at least three support projections that extend upwardly past an upper surface of the base plate. Each one of the abutment projections has a corresponding one of the support projections and each one of the abutment projections and the corresponding support projection form together a single projecting member as a unitary part of the tongues.

The projecting members are radially aligned with one another. Preferably, one of the projecting members is formed at the stay.

Expediently, the tongues have a length such that, in an initial position before receiving the workpiece, free ends of the tongues abut one another. The tongues preferably have a length such that, in an initial position before receiving the workpiece, free ends of the tongues abut an abutment arranged between the free ends, wherein the abutment is a radial projection extending radially inwardly from the peripheral wall of the perforation at a location opposite the stay.

According to the present invention, the means for receiving and clamping is in the form of at least two elastic tongues that are displaceable within the plane of the base plate, located within a perforation of the base plate, and act as pairs on the workpiece to be clamped.

When a perforation is provided with one pair of elastic tongues as the clamping means, the tongues are preferably arranged opposite one another for receiving the workpiece to be clamped therebetween and for enclosing a range of respectively more than 90°, whereby the tongues are connected with a stay to the base plate. The perforation preferably communicates with the cutout that is formed and delimited by the elastic tongues at a side opposite the stay, whereby the tongues are concentrically surrounded by the perforation.

It is advantageous to provide the cutout or the perforation with at least one abutment that is formed from the base plate, for receiving the workpiece to be clamped.

This can be achieved by using the stay connecting the elastic tongues with the base plate or by providing tongues, preferably their free ends, with an inwardly extending projection for abutting at the workpiece to be clamped. In another embodiment the abutment may be in the form of two support surfaces that diverge relative to one another and delimit the perforation.

In order to ensure a very secure holding of a workpiece to be clamped, it is suggested according to a further embodiment of the present invention that the elastic tongues are completely or partially supported at the inner surface of the perforation of the base plate during clamping.

For this purpose, the elastic tongues may rest with projections formed at their outer surface, preferably within the vicinity of the end faces, at the inner surface of the perforation of the base plate, when the workpiece is clamped. Alternatively, the distance between the outer surface of the elastic tongues and the inner surface of the perforation of the base plate can be selected such that the elastic tongues with the workpiece clamped therebetween rest at the base plate with at least a portion of their outer surface. When the elastic tongues are convexly curved, they may rest with their free ends at the inner surface of the perforation of the base plate, when the workpiece is received and clamped.

In order to increase the clamping force of the elastic tongues and/or in order to be able to manufacture the base plate of a material with low elasticity, it is furthermore expedient to provide the elastic tongues with a preferably prestressed insert or sleeve in the form of a spring ring, a leaf spring, etc.

A perforation may be equipped with two convexly curved elastic tongues arranged opposite the abutment surface; however, it is also possible to provide a perforation with four tongues arranged in pairs diametrically opposite one another, whereby the tongues are preferably convexly curved.

Furthermore, the perforations of the base plate, which is preferably made of a transparent (plastic) material by injection molding, should be in the form of a circular ring or a rectangle.

According to another embodiment of the present invention, the elastic tongues may be provided with axial projections extending in the axial direction of the workpiece to be secured. Preferably, the axial projections are connected to the underside of the base plate. The tensioning inserts and/or sleeves in this embodiment should be positioned in (embedded) and/or on the projections.

In order to facilitate cleaning of the holding device with inserted workpieces, it is furthermore suggested to provide the elastic tongues with three or more projections extending radially inwardly from their inner surface, whereby one of the projections is arranged in the area of the stay connecting the elastic tongues to the base plate and the other projections are preferably arranged in the end zone (free end) of each elastic tongue. A medium for cleaning can thus pass between the elastic tongue and the base plate.

In order to prevent test tubes from resting at the base plate, the elastic tongues furthermore should be provided with three or more support projections extending upwardly past the upper surface of the base plate. Each support projection should be shaped together with an abutment projection at the tongues to form a projecting member. The resulting projecting members should preferably be arranged radially aligned with one another at the elastic tongues, respectively, at the tongues and the stay, i.e., they should point toward the center of the cutout.

In order to prevent that the elastic tongues during cleaning in a hot atmosphere or medium, without a test tube being clamped within the holding device, be deformed, the tongues should be selected to have such a length that the elastic tongues in the initial position abut at one another with their free end faces or rest at an abutment. In a simple embodiment, the abutment cooperating with the free end faces of the elastic tongues may be provided by a radial projection at the inner surface of the base plate arranged opposite the stay that connects the elastic tongues to the base plate.

When a device for holding rod-shaped workpieces according to the present invention is provided with clamping means that are comprised of at least two elastic tongues that are displaceable in the plane of the base plate and which are formed out of the base plate, it is ensured that a workpiece inserted between the elastic tongues is always arrested in a reliable manner. When furthermore an abutment for the workpiece is provided, the workpiece is also exactly positioned so that the holding device may also be used for automated operations.

The constructive expenditure with which this is achievable, is minimal because the base plate must only be provided with a corresponding perforation in order to provide a receiving means for receiving the workpiece to be clamped and to provide elastic tongues engaging the workpiece. The device thus can be manufactured economically by injection molding. Since the workpieces, despite a low material thickness of the base plate can be clamped fixedly, rattling noise during transport is prevented. Furthermore, the workpieces, depending on the desired application, can be clamped at different levels in the holding device and can also be tilted, for example, for emptying test tubes. It is furthermore advantageous that manufacturing tolerances of the workpieces to be clamped can be automatically compensated by the elastic tongues automatically. The inventive device is thus especially suitable and advantageous for laboratory apparatus as well as for the use with photometric apparatus for the purpose of holding test tubes. Furthermore, the required handling and manipulation is considerably facilitated by the inventive device.

DESCRIPTION OF PREFERRED EMBODIMENTS

The present invention will now be described in detail with the aid of several specific embodiments utilizing FIGS. 1 through 22*b*.

Figure 1A:
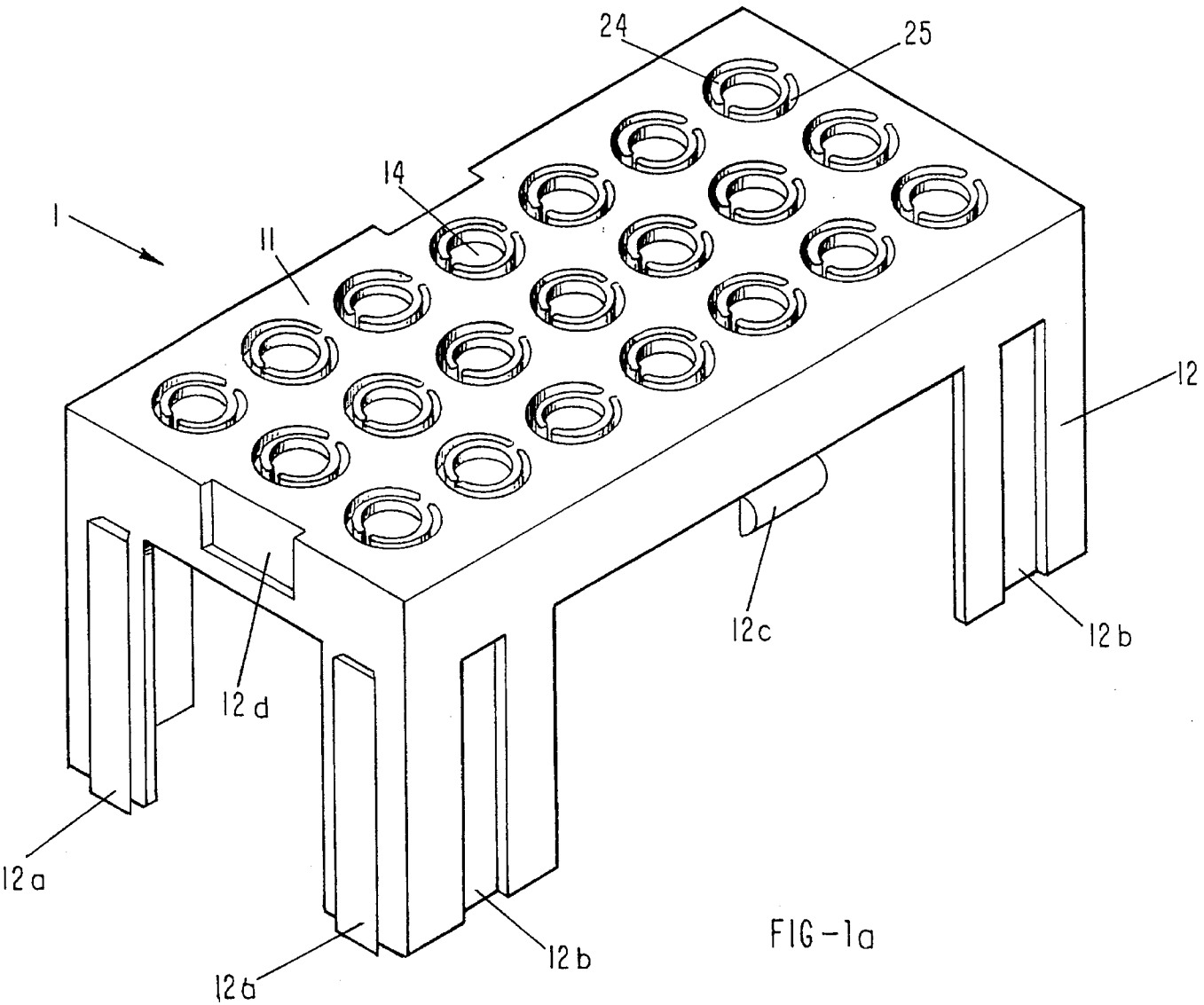
FIG. 1*a* shows in a perspective view a different embodiment of the present invention with means for interlocking two or more holding devices.

The holding device 1 of the present invention represented in FIG. 1 serves for receiving and holding rod-shaped workpieces, for example, test tubes 10, and is comprised of a base plate 11 for receiving the test tubes 10, two sidewalls 12 formed on two oppositely arranged longitudinal sides of the base plate 11, and supports 13 projecting from the sidewalls 12 for supporting the device on a support surface A. The base plate 11 is provided with cutouts 14 as well as means 21 for receiving and clamping which act on the test tubes 10 to be inserted into the cutouts 14. The holding device can be made of any suitable material, for example, metal or plastic. Other shapes than the one presented are also possible, for example, instead of two sidewalls the holding device may have four legs, one at each corner of the base plate, or the holding device may have four sidewalls, preferably with cutouts that may extend to the support surface in order to reduce the amount of material used for manufacture (see FIG. 1*a*). The sidewalls or legs may be provided with members for interlocking two or more of the holding devices side by side, for example, in the manner of a tongue and groove arrangement 12*a*, 12*b* and a snap connection 12*c*, 12*d* (see FIG. 1*a*), whereby two adjacent sides of the holding device have the same interlocking and snap means, while the two other sides are provided with the matching interlocking and snap means.

Figure 3:
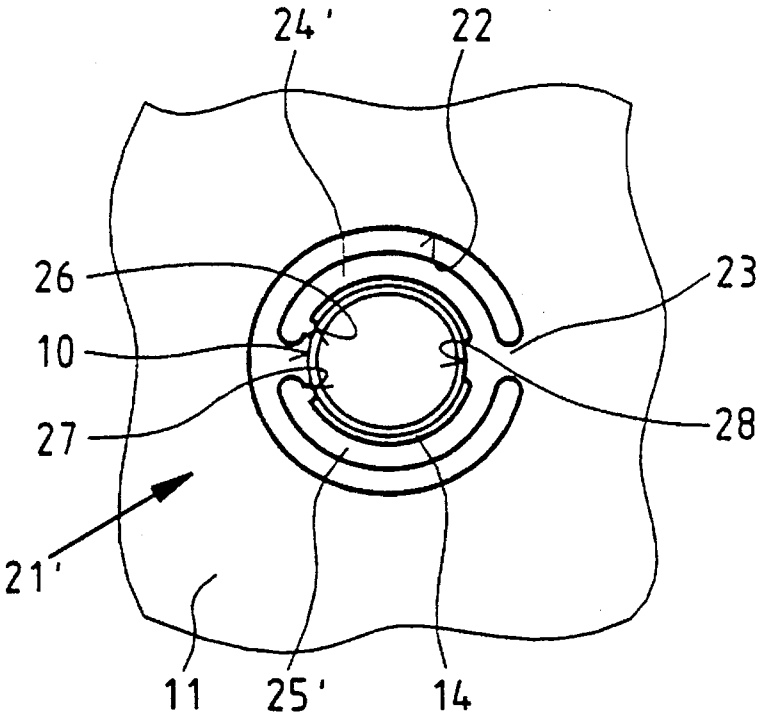
FIGS. 2 to 4 show plan view the means for clamping for the device of FIG. 1 in various embodiments.
Figure 2:
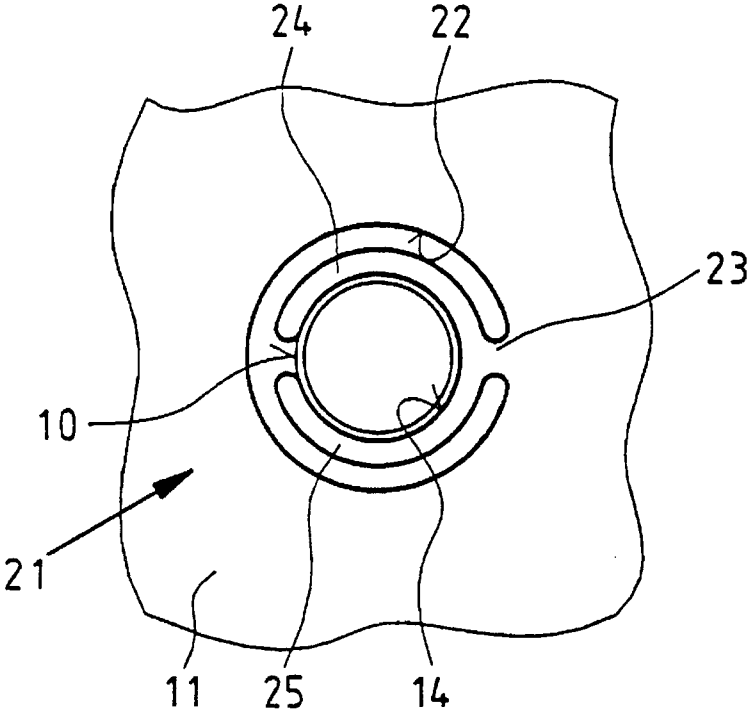
Figure 4:
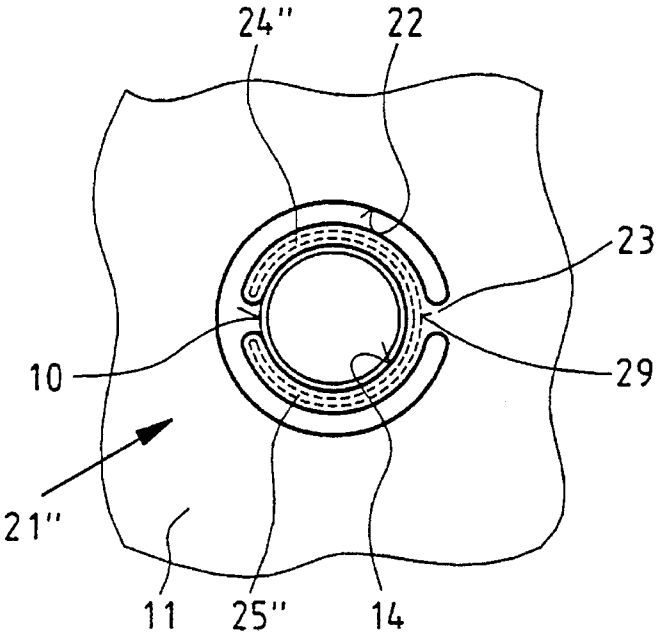

The means 21, 21', 21" for clamping and receiving, as shown especially in FIGS. 2 to 4, are formed by perforations 22 within the base plate 11 that define semi-circular oppositely arranged elastic tongues 24 and 25. The elastic tongues 24, 25 are connected by a stay 23 to the base plate 11. The clamped test tube 10 is thus engaged by each of the elastic tongues 24 and 25 in a range of more than 90° so that the test tube 10 is securely arrested within the cutout 14.

The means for clamping 21' according to FIG. 3 has elastic tongues 24', 25' with projections 26, 27 formed at the free ends of the tongues which project inwardly and rest at the test tube 10. Accordingly, the test tube 10 is forced against the stay 23 which forms an abutment 28 so that the test tube is exactly fixed in this predetermined position.

Figure 6:
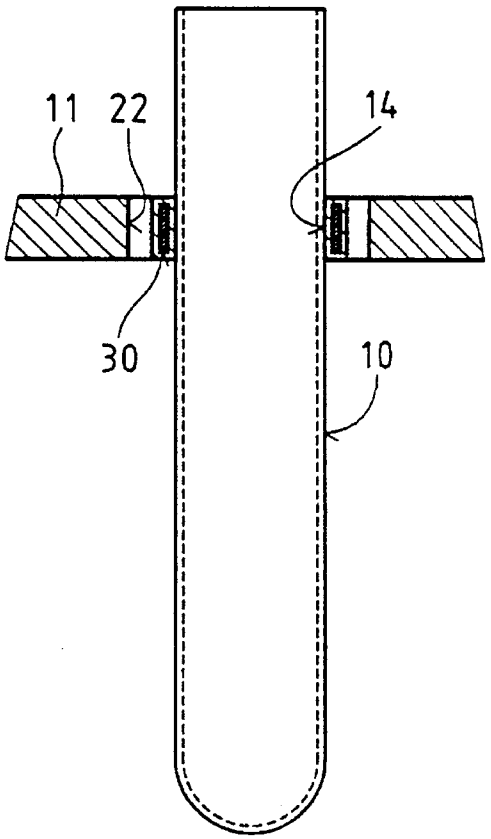
FIGS. 5 and 6 show the clamping means according to FIG. 4 in different variants in a vertical section along the axis.
Figure 5:
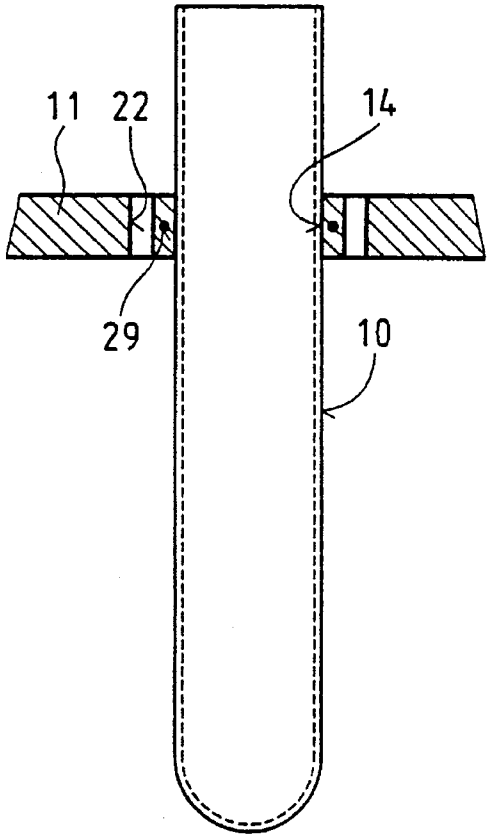

According to FIGS. 4 to 6, the holding device 21" is made of plastic material, and the elastic tongues 24" and 25" of the clamping means 21" are provided with prestressed inserts in the form of an elastic metal ring 29 or a metal leaf spring 30. There are various ways to embed the insert into the plastic material. For example, the insert can be placed into a mold into which the plastic material is then introduced for molding the holding device. A preferred method is as follows. The plastic holding device is molded in a first step and the insert is then positioned at the molded holding device at a location where it is to be introduced into the plastic material. The metal insert is then heated either inductively (as shown schematically in FIG. 21*b*) or by applying electric current to it (as shown schematically in FIG. 22*a*). The heated insert softens or melts the plastic material in its vicinity and can be pressed into the softened plastic or, when under sufficient prestress, forces itself into the softened plastic material. The tongues 24 and 25 of FIGS. 21*a*, 21*b* and 22*a*, 22*b* have abutment projections 63–65 as shown in connection with FIG. 16 and extend downwardly past the base plate for greater stability. Accordingly, the clamping force of the elastic tongues 24", 25" is increased so that the base plate 11 may be manufactured of a material that has only a minimal elasticity. However, the test tubes 10 are securely arrested with this inventive embodiment.

Figure 7:
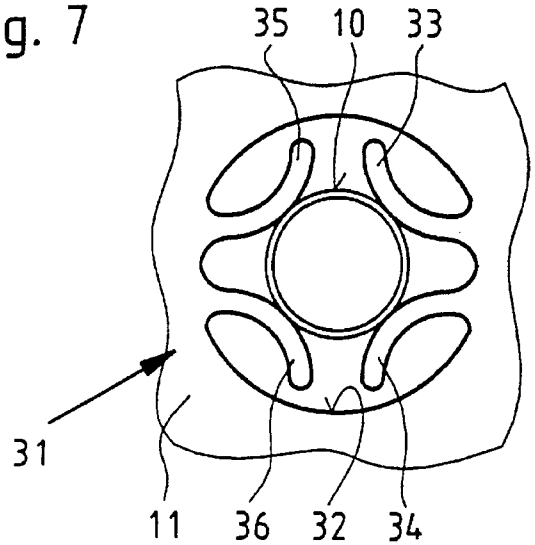
FIG. 7 shows a further embodiment of the clamping means for the device of FIG. 1 in a plan view.

The clamping means 31 shown in FIG. 7 are provided in a base plate 11 with perforations 32. The perforation 32 is provided with four elastic stays 33, 34, 35, 36 that are arranged in pairs diametrically opposite one another. Furthermore, the elastic stays 33, 34, 35, 36 are convexly curved so that the test tube 10 is centered between them.

Figure 8:
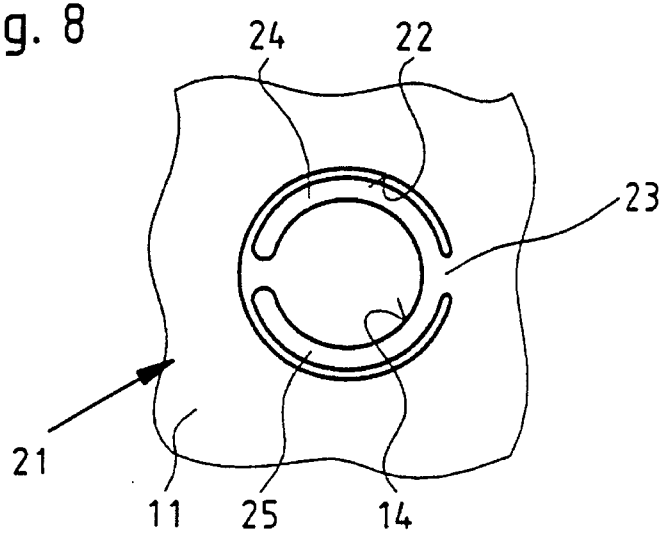
FIGS. 8 to 10 show variants of the clamping means represented in FIGS. 2 and 7.
Figure 10:
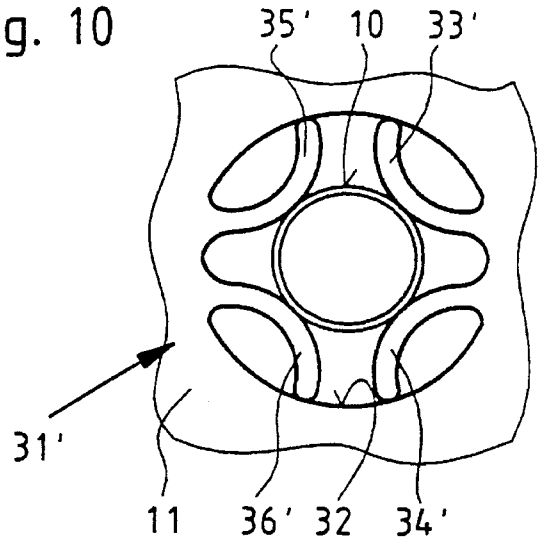
Figure 9:
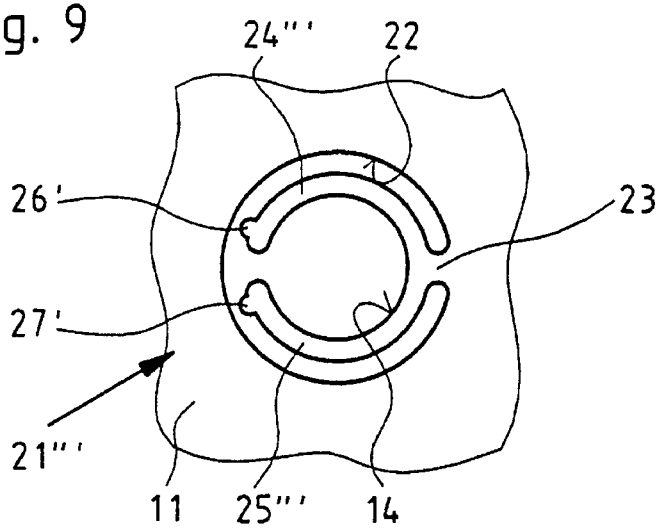

In the embodiment shown in FIGS. 8, 9, and 10, the clamping means 21, 21''' and 31', which correspond substantially to the embodiments according to FIGS. 2 and 7, the elastic tongues 24, 25, 24''', 25''', 33', 34', 35', 36' are supported on the inner surface of the perforation 22 or 32 of the base plate 11 when a test tube 10 is inserted. In this manner, an especially fast clamping of the test tube 10 is ensured because the elastic tongues 24, 25, 24''', 25''', 33' to 36' are secured in their position and cannot be displaced even when greater loads are exerted.

For this purpose, according to FIG. 8 the distance between the outer surface of the elastic tongues 24 and 25 and the inner surface of the perforation 22 is selected such that upon insertion of a test tube 10 the elastic tongues 24 and 25 rest at least over a portion of their outer surface at the base plate 11. According to FIG. 9, the elastic tongues 24''' and 25''' are provided for the same purpose with outwardly extending projections 26' and 27' at their free end sections which upon insertion of a test tube 10 into the cutout 14 rest at the inner surface of the perforation 22 within the base plate 11. According to FIG. 10, the convexly curved elastic tongues 33' to 36' are designed such that upon insertion of a test tube 10 their free ends rest at the inner surface of the perforation of the base plate 11.

Figure 13:
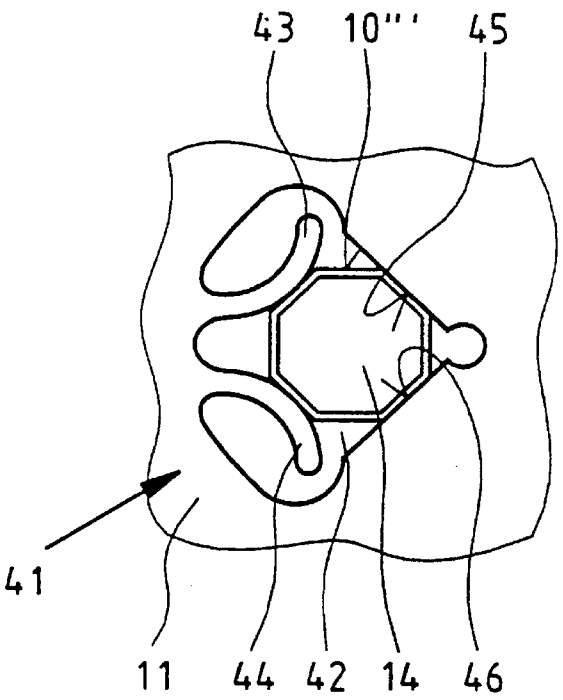
FIGS. 11 to 13 show further clamping means in embodiments with abutments in a plan view.
Figure 12:
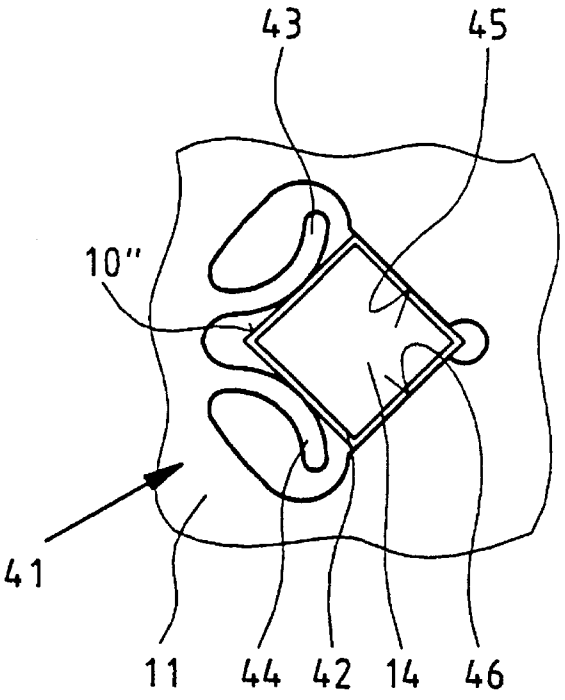
Figure 11:
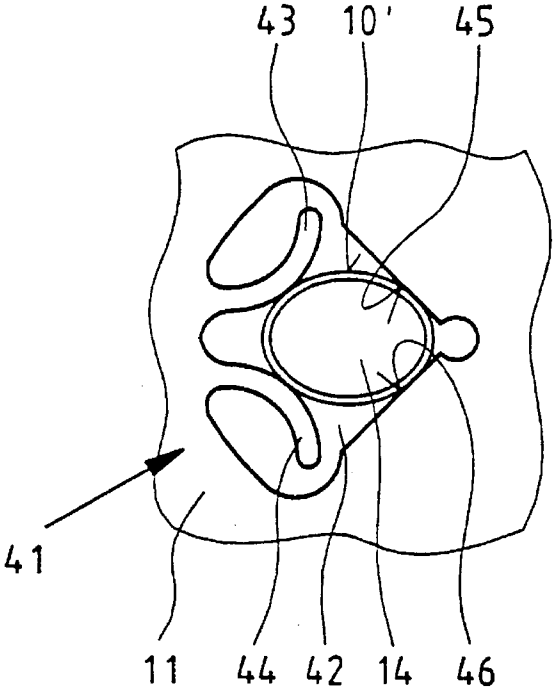

The clamping means 41 represented in FIGS. 11 to 13 comprises a perforation 42 in the form of a rectangle provided in the base plate 11 so that the elastic tongues 43 and 44 arranged as a pair within the perforation 42 have oppositely arranged support surfaces 45 and 46 that serve as an abutment. The differently embodied test tubes 10', 10" and 10''' to be inserted into the cutout 14 are thus forced by the elastic tongues 43 and 44 against the support surfaces 45 and 46 so that the test tubes 10', 10", 10''' are exactly positioned.

Figure 15:
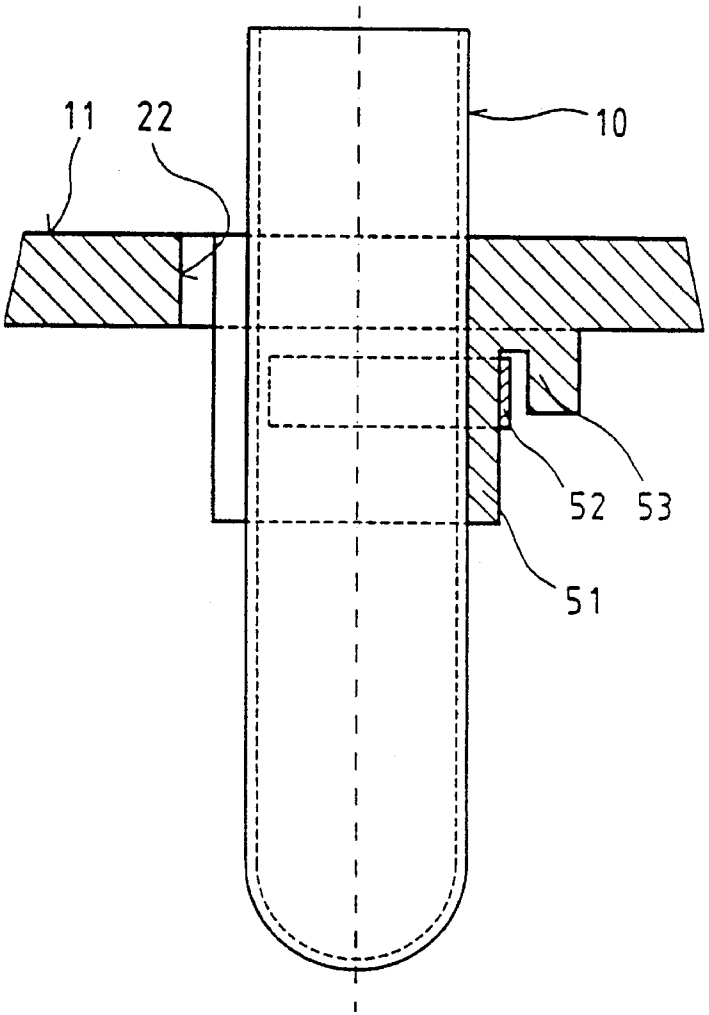
FIG. 15 shows a section along the line XV—XV of FIG. 14.
Figure 14:
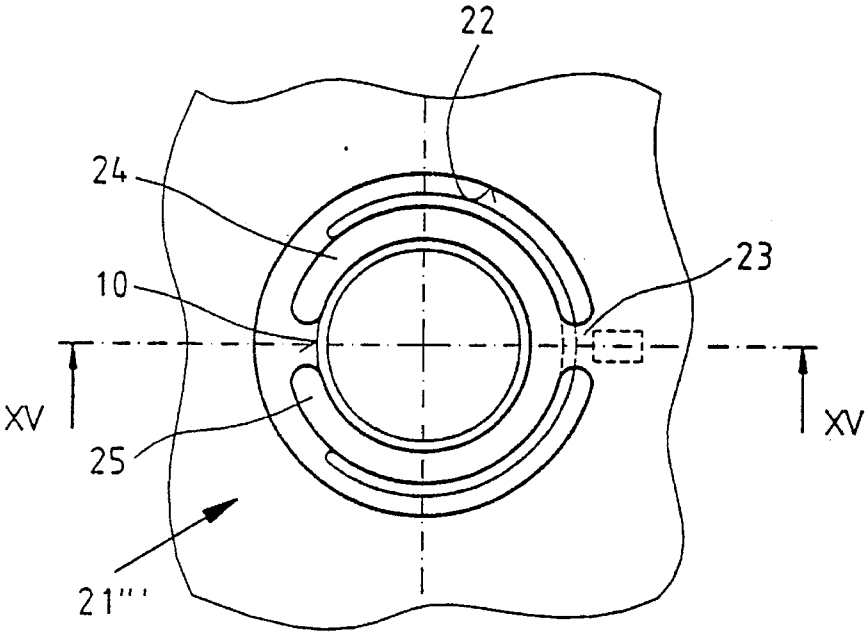
FIG. 14 shows a further embodiment of a clamping means for the device of FIG. 1 in a plan view.
Figure 17:
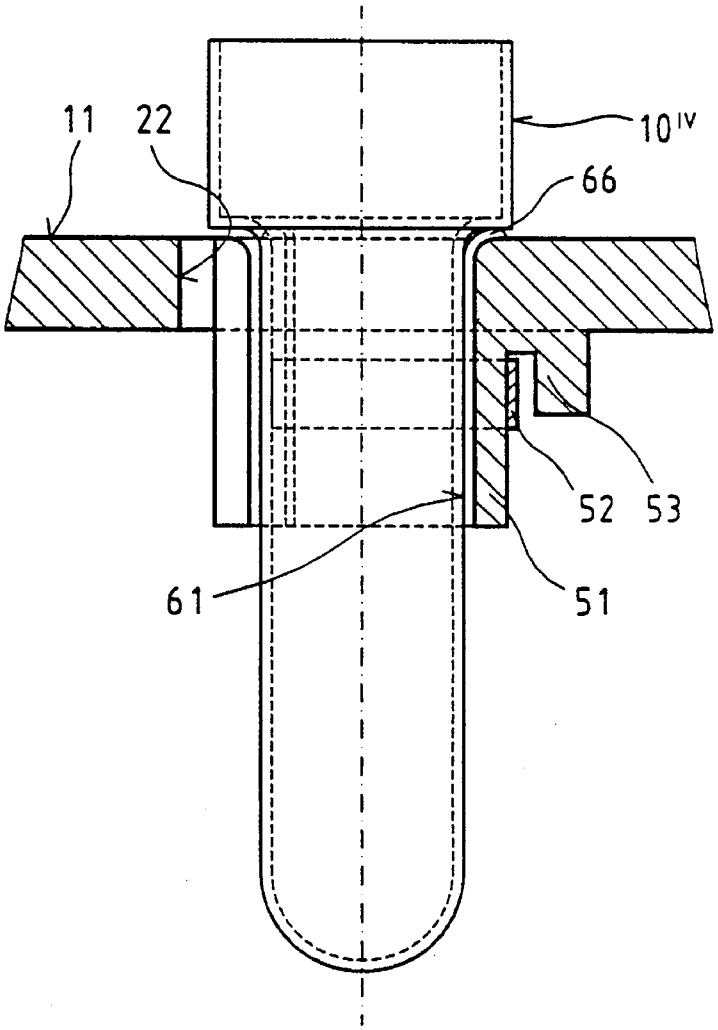
FIG. 17 shows a section along the line XVII—XVII of FIG. 16.
Figure 16:
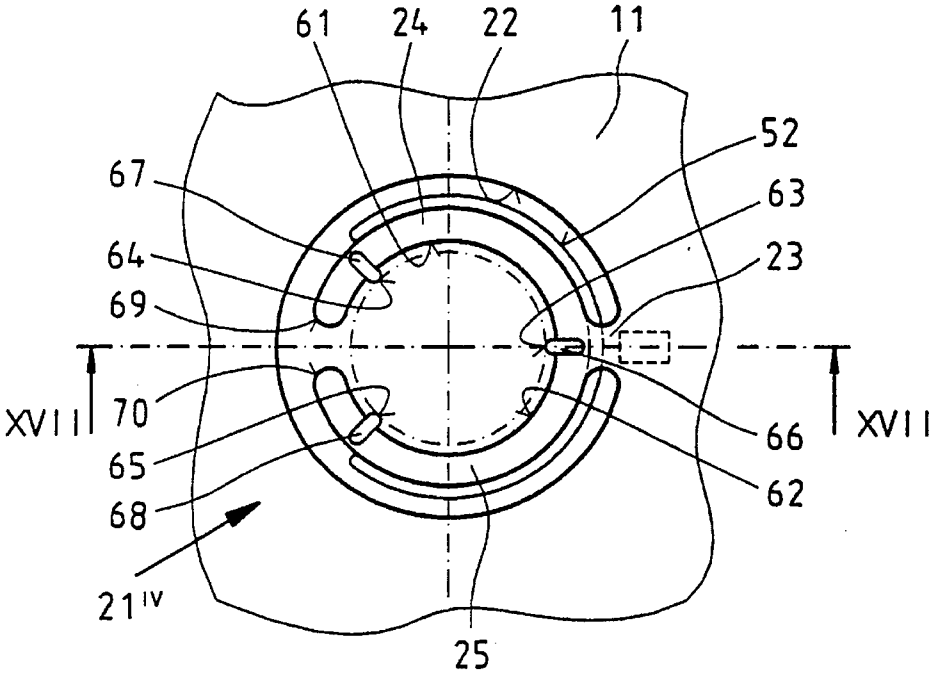
FIG. 16 shows the embodiment of FIG. 14 with formed abutment and support projections in a plan view.

According to the embodiment shown in FIGS. 14 and 15, the elastic tongues 24 and 25 are provided with axial projections 51 extending from the underside of the base plate 11 in the axial direction of the workpiece 10 to be secured. The tensioning sleeves 52 in the form of leaf springs are positioned on the projection 51 so that the workpiece 10 upon insertion into the device 1 is guided and clamped over a large area. The base plate 11 is further provided with a nose 53 that secures the sleeves 52.

The clamping means $\mathbf{21}^{IV}$ represented in FIGS. 16 to 19 and preferably made of plastic material is provided with elastic tongues 24 and 25 that have formed thereat abutment projection 63, 64, 65 and also support projections 66, 67, 68 which project past the upper surface of the base plate 11. Each abutment projection 63 to 65 has a corresponding support projection 66 to 68 and both are formed together at the elastic tongues 24 and 25 in their end sections, respectively in the area of the stay 23 connecting the tongues to the base plate 11. With this embodiment a three-point support, respectively, abutment of a test tube $\mathbf{10}^{IV}$ is ensured. It is especially advantageous that between the inner mantle surface 61 and 62 of the elastic tongues 24 and 25 and the inserted and clamped test tube $\mathbf{10}^{IV}$, respectively, between the collar of the test tube that projects past the base plate 11 and the base plate 11 no deposit can form and that these surfaces are easy to clean because a cleaning medium can pass through.

Figure 19:
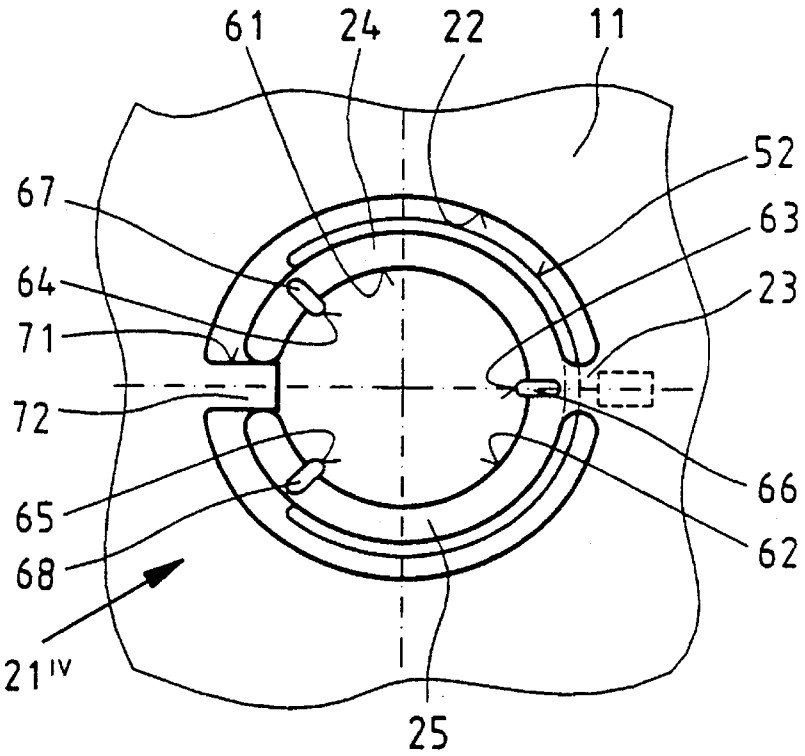
FIG. 19 shows the embodiment of FIG. 16 with an abutment arranged between the free ends of the tongues.
Figure 18:
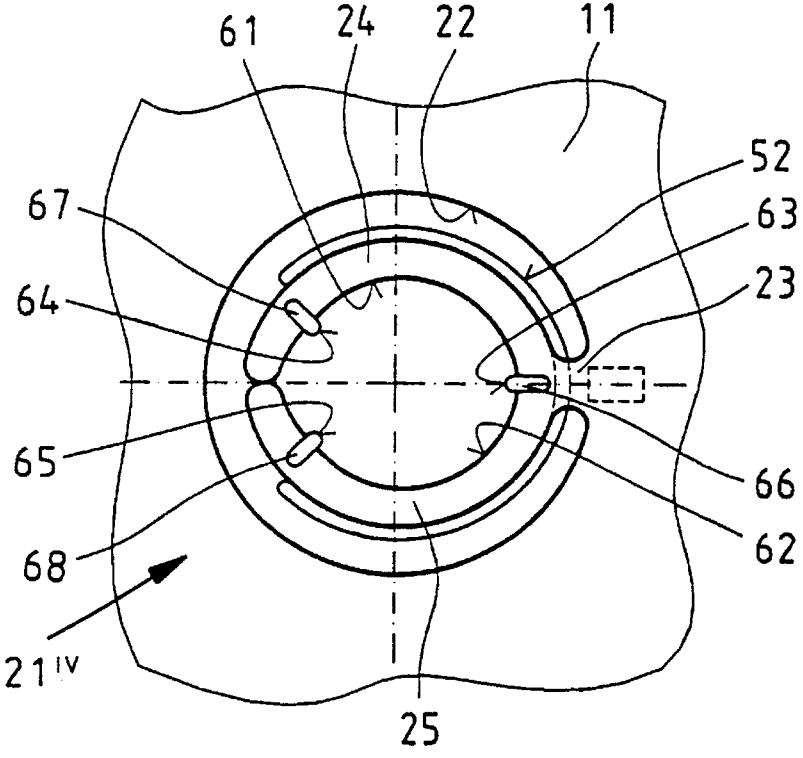
FIG. 18 shows an embodiment according to FIG. 16 with abutting end faces of the tongues.

According to FIG. 18 the elastic tongues 24 and 25 are selected in their length such that in an initial position their free end faces 69 and 70 abut one another, or, in the alternative according to FIG. 19, abut at an abutment 71 arranged between them. The abutment 71 is formed by a projection 72 extending radially from the inner surface of the base plate. It is thus prevented that during cleaning of the holder 1 in a hot atmosphere or hot medium, the elastic tongues 24 and 25 are deformed such that the outward bending of the tongues upon insertion of a workpiece or test tube would require an excessive force. Instead, the clamping force of the elastic tongues 24 and 25 is essentially constant since an inward deformation during cleaning is impossible.

Figure 20:
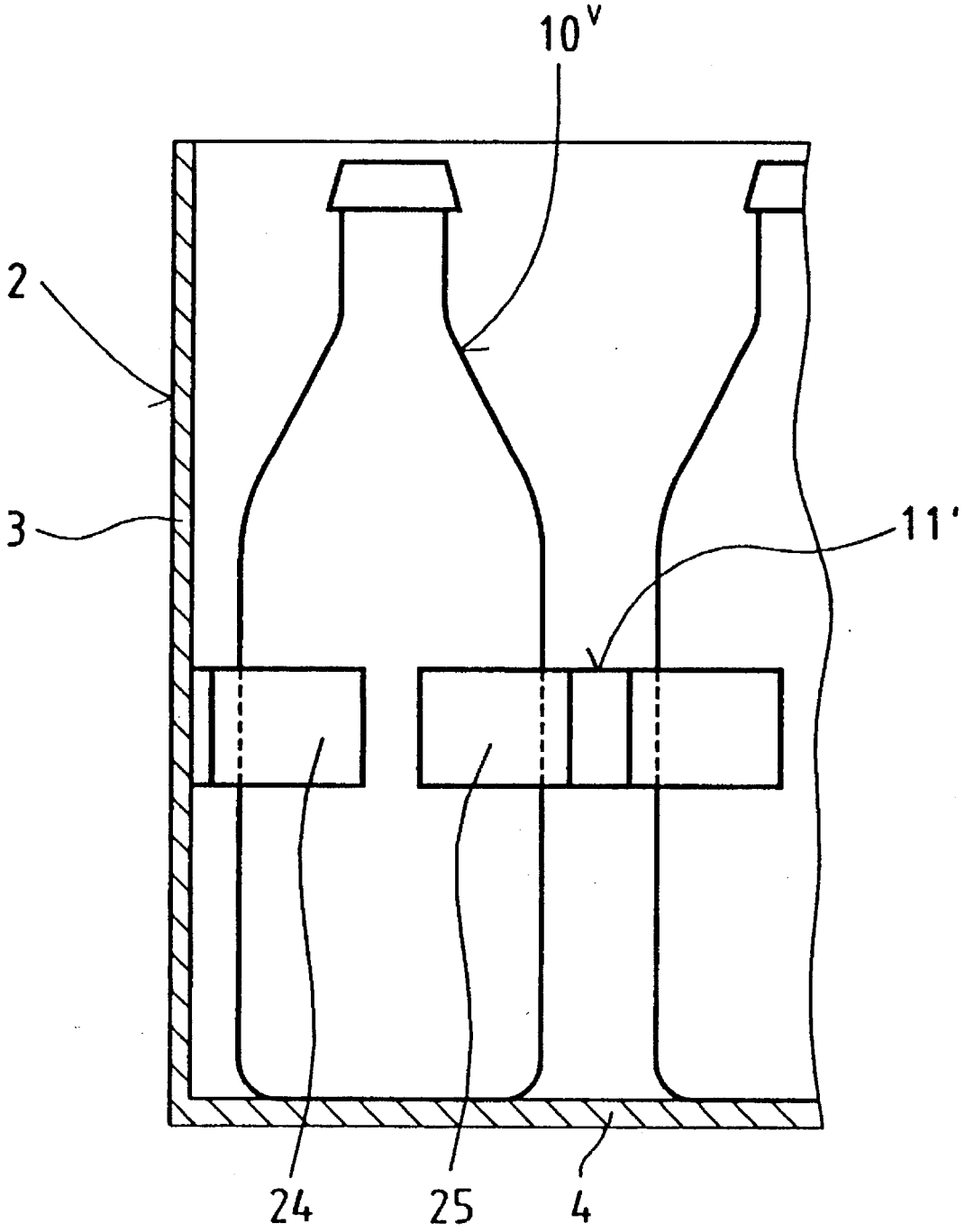
FIG. 20 shows the mounting of a base plate of the holding device of FIG. 1 in a receiving container.
Figure 21A:
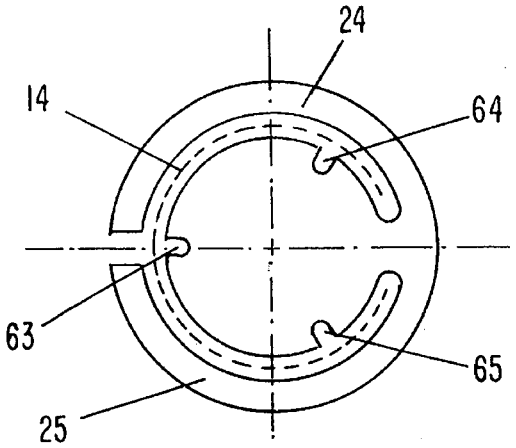
FIGS. 21*a*, 21*b* show schematically the embedding of the elastic metal ring into the plastic material by induction-heating of the metal ring.
Figure 21B:
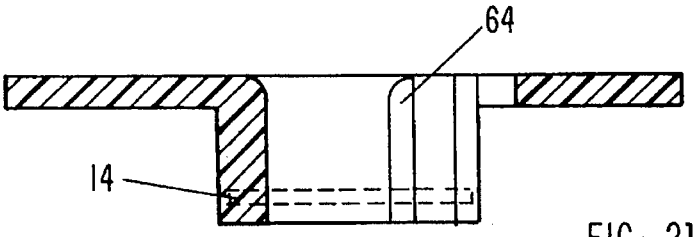
Figure 22A:
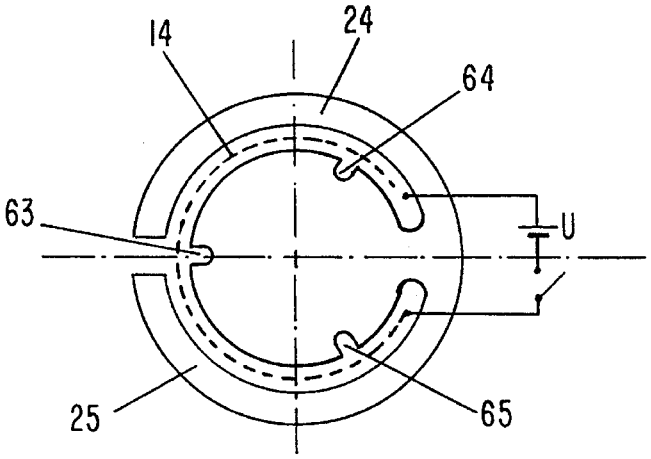
FIGS. 22*a*, 22*b* show schematically the embedding of the elastic metal ring into the plastic material by electrically heating the metal ring.
Figure 22B:
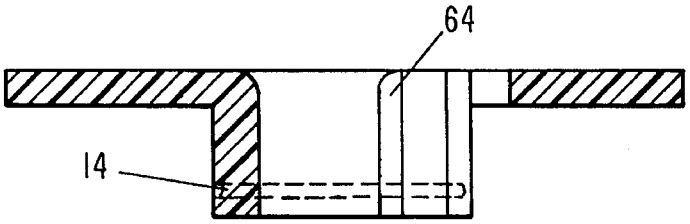

FIG. 20 shows a clamping means in the form of elastic tongues 24 and 25 within the base plate 11' for receiving bottles $\mathbf{10}^{V}$. The base plate 11' is positioned in a container 2. The base plate 11' is attached to the sidewalls 3 of the container 2 at a distance to the bottom 4 so that the bottles $\mathbf{10}^{V}$ inserted from the top into the base plate 11' are secured within the container 2 without allowing for accidental displacement.

The present invention is, of course, in no way restricted to the specific disclosure of the specification and drawings, but also encompasses any modifications within the scope of the appended claims.

What I claim is:

1. A device for holding rod-shaped workpieces, said device comprised of:

a base plate having means for spacing said base plate at a distance from a support surface;

a means on said base plate for receiving and clamping a workpiece;

said means for receiving and clamping having at least two elastic tongues that are displaceable in a plane of said base plate;

said tongues positioned in a perforation within said base plate;

said tongues acting in pairs on the workpiece; and said tongues comprising a tensioning means for biasing said tongues toward the workpiece, said tensioning means being an insert embedded in said tongues.

2. A device according to claim 1, wherein said perforation has a peripheral wall and wherein said means for receiving and clamping is comprised of one of said pair of said tongues, said tongues arranged opposite one another for receiving the workpiece therebetween such that each of said tongues engages the workpiece with a range of more than 90° over a periphery of the workpiece, wherein said tongues have a first and a second end and a common stay for connecting said first ends of said tongues to said peripheral wall of said perforation at a common location opposite said second ends.

3. A device according to claim 2, wherein said tongues enclose a cutout for receiving the workpiece and wherein said perforation at a location diametrically opposite said stay communicates with said cutout and is positioned concentrically relative to said tongues.

4. A device according to claim 3, wherein said cutout has at least one abutment that is formed as a unitary part of said base plate at said stay.

5. A device according to claim 2, wherein each one of said tongues has an inwardly extending abutment projection for abutting the workpiece.

6. A device according to claim 5, wherein said abutment projection is positioned at a free end of said tongue.

7. A device according to claim 1, wherein said tongues are at least partially supported at said peripheral wall of said perforation, when the workpiece is inserted between said tongues.

8. A device according to claim 7, wherein said tongues have outwardly extending projections that rest at said peripheral wall of said perforation, when the workpiece is inserted between said tongues.

9. A device according to claim 1, wherein said insert is selected from the group consisting of a spring ring and a leaf spring.

10. A device according to claim 2, wherein said tongues have at least three abutment projections that extend radially inwardly from said peripheral wall of said tongues and are formed as a unitary part of said tongues.

11. A device according to claim 10, wherein one of said abutment projections is positioned at said stay and wherein two of said abutment projections are positioned at free ends of said tongues.

12. A device according to claim 10, wherein said tongues have at least three support projections that extend upwardly past an upper surface of said base plate.

13. A device according to claim 12, wherein:

each one of said abutment projections has a corresponding one of said support projections;

each one of said abutment projections with said corresponding support projection forming together a single projecting member as a unitary part of said tongues; and said projecting members are radially aligned with one another.

14. A device according to claim 13, wherein one of said projecting members is formed at said stay.

15. A device according to claim 1, wherein said tongues have a length such that, in an initial position before receiving the workpiece, free ends of said tongues abut one another.

16. A device according to claim 2, wherein said tongues have free ends and a length such that, in an initial position before receiving the workpiece, said free ends of said tongues abut an abutment arranged between said free ends, wherein said abutment is a radial projection extending radially inwardly from said peripheral wall of said perforation at a location opposite said stay.

17. A device for holding rod-shaped workpieces, said device comprised of:

a base plate having means for spacing said base plate at a distance from a support surface;

a means on said base plate for receiving and clamping a workpiece;

said means for receiving and clamping having at least two elastic tongues that are displaceable in a plane of said base plate;

said tongues positioned in a perforation in said base plate;

said tongues acting in pairs on the workpiece;

said tongues having projections extending in an axial direction of the workpiece and connected to a downwardly facing side of said tongues;

said tongues having a tensioning means for biasing said tongues toward the workpiece, said tensioning means being an insert embedded in said projections.

18. A device according to claim 17, wherein said perforation has a peripheral wall and wherein said means for receiving and clamping is comprised of one of said pair of said tongues, said tongues arranged opposite one another for receiving the workpiece therebetween such that each of said tongues engages the workpiece with a range of more than 90° over a periphery of the workpiece, wherein said tongues have a first and a second end and a common stay for connecting said first ends of said tongues to said peripheral wall of said perforation at a common location opposite said second ends.

19. A device according to claim 18, wherein said tongues enclose a cutout for receiving the workpiece and wherein said perforation at a location diametrically opposite said stay communicates with said cutout and is positioned concentrically relative to said tongues.

20. A device according to claim 19, wherein said cutout has at least one abutment that is formed as a unitary part of said base plate at said stay.

21. A device according to claim 18, wherein each one of said tongues has an inwardly extending abutment projection for abutting the workpiece.

22. A device according to claim 21, wherein said abutment projection is positioned at a free end of said tongue.

23. A device according to claim 18, wherein said tongues are at least partially supported at said peripheral wall of said perforation, when the workpiece is inserted between said tongues.

24. A device according to claim 23, wherein said tongues have outwardly extending projections that rest at said peripheral wall of said perforation, when the workpiece is inserted between said tongues.

25. A device according to claim 17, wherein said insert is selected from the group consisting of a spring ring and a leaf spring.

26. A device according to claim 18, wherein said tongues have at least three abutment projections that extend radially inwardly from said peripheral wall of said tongues and are formed as a unitary part of said tongues.

27. A device according to claim 26, wherein one of said abutment projections is positioned at said stay and wherein two of said abutment projections are positioned at free ends of said tongues.

28. A device according to claim 26, wherein said tongues have at least three support projections that extend upwardly past an upper surface of said base plate.

29. A device according to claim 28, wherein:

each one of said abutment projections has a corresponding one of said support projections;

each one of said abutment projections with said corresponding support projection forming together a single projecting member as a unitary part of said tongues; and said projecting members are radially aligned with one another.

30. A device according to claim 29, wherein one of said projecting members is formed at said stay.

31. A device according to claim 17, wherein said tongues have a length such that, in an initial position before receiving the workpiece, free ends of said tongues abut one another.

32. A device according to claim 18, wherein said tongues have a length such that, in an initial position before receiving the workpiece, free ends of said tongues abut an abutment arranged between said free ends, wherein said abutment is a radial projection extending radially inwardly from said peripheral wall of said perforation at a location opposite said stay.

* * * * *